US007238651B2

(12) United States Patent
Kocsis et al.

(10) Patent No.: US 7,238,651 B2
(45) Date of Patent: Jul. 3, 2007

(54) PROCESS FOR PREPARING AN OVERBASED DETERGENT

(75) Inventors: Jody A. Kocsis, Chagrin Falls, OH (US); Albert F. Baumann, Highland Heights, OH (US); Jack L. Karn, Richmond Heights, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 11/279,947

(22) Filed: Apr. 17, 2006

(65) Prior Publication Data

US 2006/0178278 A1 Aug. 10, 2006

Related U.S. Application Data

(63) Continuation-in-part of application No. PCT/US2004/036152, filed on Oct. 29, 2004.

(60) Provisional application No. 60/515,809, filed on Oct. 30, 2003.

(51) Int. Cl.
*C10M 159/24* (2006.01)

(52) U.S. Cl. ..... 508/392; 508/401; 508/585

(58) Field of Classification Search ..... 508/392, 508/401, 585

See application file for complete search history.

(56) References Cited

U.S. PATENT DOCUMENTS

| | | | | |
|---|---|---|---|---|
| 3,376,222 | A * | 4/1968 | McMillen | 508/392 |
| 4,698,170 | A | 10/1987 | Le Coent | |
| 4,880,550 | A | 11/1989 | Hunt | |
| 4,995,993 | A | 2/1991 | Papke et al. | |
| 5,108,631 | A | 4/1992 | Barrer et al. | |
| 5,259,966 | A | 11/1993 | Burke, Jr. et al. | |
| 5,792,732 | A | 8/1998 | Jao et al. | |
| 6,107,259 | A | 8/2000 | Muir et al. | |
| 6,153,565 | A | 11/2000 | Skinner et al. | |
| 6,200,936 | B1 | 3/2001 | Moreton | |
| 6,268,318 | B1 | 7/2001 | Rolfes et al. | |
| 6,281,179 | B1 | 8/2001 | Skinner et al. | |
| 6,331,510 | B1 * | 12/2001 | Curtis et al. | 508/578 |
| 6,417,148 | B1 | 7/2002 | Skinner et al. | |
| 6,429,178 | B1 | 8/2002 | Skinner et al. | |
| 6,429,179 | B1 | 8/2002 | Skinner et al. | |
| 6,444,625 | B1 | 9/2002 | Muir et al. | |
| 2002/0151445 | A1 * | 10/2002 | Curtis et al. | 508/578 |

FOREIGN PATENT DOCUMENTS

EP 949322 A2 * 3/1999

OTHER PUBLICATIONS

International Preliminary Report on Patentability, Feb. 10, 2006, from PCT/US 2004/036152, corresponding to the present application.

* cited by examiner

*Primary Examiner*—John R. Hardee
(74) *Attorney, Agent, or Firm*—David M. Shold; Michael F. Esposito

(57) ABSTRACT

The invention relates to a process for preparing an overbased metal detergent in an oil medium comprising the steps of: (1) providing a metal salt selected from the group consisting of a hydrocarbyl-substituted organic acid; a hydrocarbyl-substituted phenol, a phenate, a hydrocarbyl-substituted carboxylate and mixtures thereof; (2) further providing methanol and a mixture of alcohols containing 2 to about 7 carbon atoms, wherein the mole ratio of methanol to the mixture of alcohols is about 2.2 or less, to form a mixture; (3) further providing a basic metal compound; (4) reacting the mixture of step (3) with carbon dioxide to form a carbonated overbased metal sulphonate; (5) performing steps (3) and (4) at least three additional times upon the product of step (4); (6) thereafter removing at least a portion of the water produced in steps (1)-(5) and of the alcohols introduced in step (2); (7) performing step (2) again, upon the product of step (6); (8) performing steps (3) and (4) at least two additional times upon the product of step (7); and (9) thereafter removing a substantial portion of the water and of the alcohols from the composition; wherein the oil medium is present in an amount such that the weight ratio of the acid corresponding to the metal salt of (1) to the oil medium is 0.3 to 1.4; and wherein step (6) is required when the hydrocarbyl-substituted organic acid is a hydrocarbyl-substituted sulphonic acid. The invention further relates to its use in internal combustion engines.

21 Claims, No Drawings

PROCESS FOR PREPARING AN OVERBASED DETERGENT

FIELD OF INVENTION

The present invention relates to a process for preparing an overbased metal salt selected from the group consisting of a hydrocarbyl-substituted organic acid, a hydrocarbyl-substituted phenol and mixtures thereof. The overbased metal salt formed is suitable for application in an oil of lubricating viscosity.

BACKGROUND OF THE INVENTION

It is known to use overbased detergents in an oil of lubricating viscosity to reduce engine wear and improve cleanliness. Overbased detergents include sulphonates, salixarates or salicylates, and they provide alkalinity to neutralize sulphur-containing acids produced from the combustion of carbonaceous fuels. These detergents are prepared by a number of low and high temperature processes. However, the preparation of a highly overbased detergent is difficult because the in-process viscosity and final viscosity tend to be too viscous and the final product is not soluble or lacks clarity or becomes too viscous to be readily handleable.

U.S. Pat. No. 6,444,625 (Muir et al.) discloses a method for preparing a handle-able overbased metal sulphonate detergent having a TBN of 400 or more, and having a viscosity of at least 180 $mm^2s^{-1}$ (cSt) at 100° C. The process for preparing the overbased sulphonate detergent requires a solvent system containing a hydrocarbon solvent and an alcohol with 1 to 4 carbon atoms. However, the hydrocarbon solvent is known to be environmentally unfriendly requiring safe storage and disposal of waste.

It would be desirable to have a process for preparing an overbased metal detergent that is handle-able, environmentally friendly, and substantially free of hydrocarbon solvent, in a cost effective manner. The present invention provides a process for preparing an overbased metal detergent that is handle-able, environmentally friendly, and substantially free of hydrocarbon solvent, in a cost effective manner.

SUMMARY OF THE INVENTION

The present invention provides a process for preparing an overbased metal detergent in an oil medium comprising the steps of:

(1) providing a metal salt selected from the group consisting of a hydrocarbyl-substituted organic acid; a hydrocarbyl-substituted phenol, a phenate, a hydrocarbyl-substituted carboxylate and mixtures thereof;
(2) further providing methanol and a mixture of alcohols containing 2 to about 7 carbon atoms, wherein the mole ratio of methanol to the mixture of alcohols is about 2.2 or less, to form a mixture;
(3) further providing a basic metal compound;
(4) reacting the mixture of step (3) with carbon dioxide to form a carbonated overbased metal sulphonate;
(5) performing steps (3) and (4) at least three additional times upon the product of step (4);
(6) thereafter removing at least a portion of the water produced in steps (1)-(5) and of the alcohols introduced in step (2);
(7) performing step (2) again, upon the product of step (6);
(8) performing steps (3) and (4) at least two additional times upon the product of step (7); and (9) thereafter removing a substantial portion of the water and of the alcohols from the composition;

wherein the oil medium is present in an amount such that the weight ratio of the acid corresponding to the metal salt of (1) to the oil medium is 0.3 to 1.4; and wherein step (6) is required when the hydrocarbyl-substituted organic acid is a hydrocarbyl-substituted sulphonic acid.

In one embodiment the invention provides a process for preparing an overbased metal detergent in an oil medium comprising the steps of:

(1) providing a metal salt selected from the group consisting of a hydrocarbyl-substituted organic acid; a hydrocarbyl-substituted phenol, a phenate, a hydrocarbyl-substituted carboxylate and mixture thereof;
(2) further providing methanol and a mixture of alcohols containing 2 to about 7 carbon atoms, wherein the mole ratio of methanol to the mixture of alcohols is about 2.2 or less, to form a mixture;
(3) further providing a basic metal compound;
(4) reacting the mixture of step (3) with carbon dioxide to form a carbonated overbased metal sulphonate;
(5) performing steps (3) and (4) at least three additional times upon the product of step (4);
(6) thereafter removing at least a portion of the water produced in steps (1)-(5) and of the alcohols introduced in step (2);
(7) performing step (2) again, upon the product of step (6);
(8) performing steps (3) and (4) at least two additional times upon the product of step (7);
(9) thereafter removing a substantial portion of the water and of the alcohols from the composition; and
(10) a processing step of filtering or stripping the product of step (9) to form the overbased metal detergent, wherein the process if free of co-surfactant or co-promoter other than the mixture of alcohols; wherein the oil medium is present in an amount such that the weight ratio of the acid corresponding to the metal salt of (1) to the oil medium is 0.3 to 1.4; and wherein step (6) is required when the hydrocarbyl-substituted organic acid is a hydrocarbyl-substituted sulphonic acid.

The invention further provides the overbased metal detergent that is handle-able and environmentally friendly.

The invention further provides a method for lubricating an internal combustion engine, comprising supplying thereto a lubricant comprising the overbased metal detergent as described herein.

DETAILED DESCRIPTION OF THE INVENTION

The present invention provides a process for preparing an overbased metal detergent in an oil medium as described above.

As used herein the Total Base Number is a measure of the final overbased detergent containing the oil used in processing i.e. the final product has not been diluted in additional oil nor has oil been removed after processing.

The metal salt of step (1) is prepared by techniques known to those skilled in the art. Steps (1) to (3) are preferably carried out in this order. However, variations of the preferred order are also encompassed by this invention.

As used herein the term "free of", as used in the specification and claims, defines the absence of a material except for the amount which is present as impurities, e.g., a trace amount. Typically in this embodiment, the amount present will be less than about 0.05% or less than about 0.005 wt % by weight of the lubricating composition.

In one embodiment the process is carried out free of co-surfactant or co-promoter other than the mixture of alcohols. Known co-surfactant or co-promoter chemistry includes a calcium salt of a formaldehyde coupled aliphatic phenol, hydroxy-sulphonic acids, inorganic halides (such as ammonium halides, alkaline earth metal halides especially calcium chloride or alkali metal halides) or an inorganic calcium salt, such as, calcium nitrate. In one embodiment the co-surfactant or co-promoter are selected from the group consisting of a calcium salt of formaldehyde coupled aliphatic phenols, a hydroxy-sulphonic acids, inorganic halides or inorganic calcium salts.

The processing step of filtering or stripping the product of step (9) to form the overbased metal detergent may be carried out by known process to a person skilled in the art. Typically, the processing step may employ stripping carried out by nitrogen blowing or an elevated flash stripping process. Filtering or clarification may be carried out using a filter aid and support. A common filter aid is a diatomaccous earth filter in a suitable filtration system.

The process preferably results in any residual solids and residual water and alcohols being substantially completely removed from the product. As used herein the term "substantially completely" results in any residual solids and residual water and alcohols each being present at less than or equal to 2 wt %, preferably less than less than or equal to 1.8 wt %, more preferably less than or equal to 1.5 wt % and most preferably less than or equal to 1.2 wt % of the final product.

The process of step (3) often adds 5 to 40, preferably 7 to 30 and most preferably 10 to 20 percent by weight of the total amount of the basic metal compound is added at each occurrence of addition step (3). The amount of metal compound added at each addition can be the same or different.

The process of step (9) requires the removal of at least a portion of the water, often carried out by flash stripping. Often the flash stripping is carried out at a temperature of at least 115° C., preferably at least 125° C., more preferably at least 135° C. and most preferably at least 140° C.

Hydrocarbon Solvent

The process of the present invention is preferably substantially free of hydrocarbon solvent. As used herein, the term "substantially free of hydrocarbon solvent other than the oil of lubricating viscosity" is used to describe the presence of a solvent system containing the mixture of alcohols described below with less than 10 wt %, preferably less than 5 wt %, more preferably less than 2 wt % and most preferably less than 0.5 wt % hydrocarbon solvent present in the process. In one embodiment, the process is free of hydrocarbon solvent other than the oil of lubricating viscosity.

If present, hydrocarbon solvents can include aliphatic hydrocarbons or aromatic hydrocarbons. Examples of suitable aliphatic hydrocarbons include hexane, heptane, octane, nonane, decane, undecane, dodecane, tridecane and mixtures thereof. Examples of suitable aromatic hydrocarbons include benzene, xylene, toluene and mixtures thereof.

The Metal Basic Compound

The metal basic compound is used to supply excess basicity to the overbased material. The metal basic compound can be a hydroxide or oxide of the metal. The metal can be monovalent, divalent, or trivalent. When monovalent, the metal ion M can be an alkali metal, preferably lithium, sodium, or potassium; and more preferably potassium, which can be used alone or in combination with other metals. When divalent, the metal ion M can be an alkaline earth metal, preferably magnesium, calcium, barium or mixtures thereof, more preferably calcium, which can be used alone or in combination with other metals. When trivalent, the metal ion M can be aluminium, which can be used alone or in combination with other metals.

Suitable examples of metal basic compounds with hydroxide functionality include lithium hydroxide, potassium hydroxide, sodium hydroxide, magnesium hydroxide, calcium hydroxide, barium hydroxide and aluminium hydroxide. Suitable examples of metal basic compounds with oxide functionality include lithium oxide, magnesium oxide, calcium oxide and barium oxide. The oxides and/or hydroxides can be used alone or in combination. The oxides or hydroxides can be hydrated or dehydrated, although hydrated is preferred. In one embodiment the metal basic compound is calcium hydroxide, which can be used alone or mixtures thereof with other metal basic compounds. Calcium hydroxide is often referred to as lime. In one embodiment the metal basic compound is calcium oxide which can be used alone or mixtures thereof with other metal basic compounds.

The Overbased Material

Overbased materials, otherwise referred to as overbased or superbased salts, are generally single phase, homogeneous Newtonian systems characterised by a metal content in excess of that which would be present for neutralisation according to the stoichiometry of the metal and the particular acidic organic compound reacted with the metal.

The amount of excess metal is commonly expressed in terms of substrate to metal ratio. The terminology "metal ratio" is used in the prior art and herein to designate the ratio of the total chemical equivalents of the metal in the overbased salt to the chemical equivalents of the metal in the salt which would be expected to result in the reaction between the hydrocarbyl-substituted organic acid; the hydrocarbyl-substituted phenol or mixtures thereof to be overbased and the basically reacting metal compound according to the known chemical reactivity and stoichiometry of the two reactants. Thus, in a normal or neutral salt the metal ratio is one and, in an overbased salt, the metal ratio is greater than one. The overbased metal salt of the hydrocarbyl-substituted organic acid; the hydrocarbyl-substituted phenol or mixtures thereof used in this invention usually have metal ratios not exceeding 40:1 (or 40). Often, salts having ratios of 2:1 to 35:1 are used.

Metal Salt of a Hydrocarbyl-Substituted Organic Acid or a Hydrocarbyl-Substituted Phenol In one embodiment of the invention the metal salt selected from the group consisting of a hydrocarbyl-substituted organic acid, a hydrocarbyl-substituted phenol and mixtures thereof, includes a metal salt derived from a hydrocarbyl-substituted sulphonic acid, a hydrocarbyl-substituted hydroxy-aromatic acid (preferably hydroxy-benzoic acid) such as a metal salixarate or a metal salt of hydrocarbyl-salicylate.

Metal Salixarate

In one embodiment of the invention a substrate of the metal salixarate of the invention includes those represented by a substantially linear compound comprising at least one unit of the formulae (I) or (II):

(I)

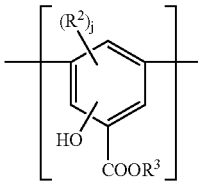

or (II)

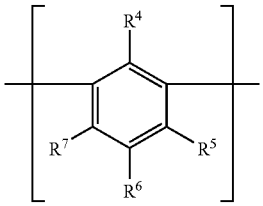

each end of the compound having a terminal group of formulae (III) or (IV):

(III)

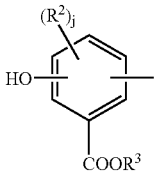

(IV)

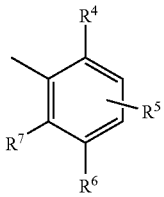

such groups being linked by divalent bridging groups B, which may be the same or different for each linkage; wherein in formulas (I)-(IV) $R^3$ is hydrogen or a hydrocarbyl group; $R^2$ is hydroxyl or a hydrocarbyl group and j is 0, 1, or 2; $R^6$ is hydrogen, a hydrocarbyl group, or a hetero-substituted hydrocarbyl group; either $R^4$ is hydroxyl and $R^5$ and $R^7$ are independently either hydrogen, a hydrocarbyl group, or hetero-substituted hydrocarbyl group, or else $R^5$ and $R^7$ are both hydroxyl and $R^4$ is hydrogen, a hydrocarbyl group, or a hetero-substituted hydrocarbyl group; provided that at least one of $R^4$, $R^5$, $R^6$ and $R^7$ is hydrocarbyl containing at least 8 carbon atoms; and wherein the molecules on average contain at least one of unit (I) or (III) and at least one of unit (II) or (IV) and the ratio of the total number of units (I) and (III) to the total number of units of (II) and (IV) in the composition is about 0.1:1 to about 2:1.

The hydroxyl group in formulae (i) and (iii) may be located in a position ortho, meta, para or mixtures thereof to the —$COOR^3$ group. Preferably the hydroxyl group is located in an ortho to the —$COOR^3$ group.

The divalent bridging group "A," which may be the same or different in each occurrence, includes —$CH_2$— (methylene bridge) and —$CH_2OCH_2$— (ether bridge), either of which may be derived from formaldehyde or a formaldehyde equivalent (e.g., paraform, formalin).

It is believed that the salixarate derivatives have a predominantly linear, rather than macrocyclic, structure, although both structures are intended to be encompassed by the term "salixarate."

It is believed that a significant fraction of salixarate molecules (prior to neutralisation) may be represented on average by the following formula:

(V)

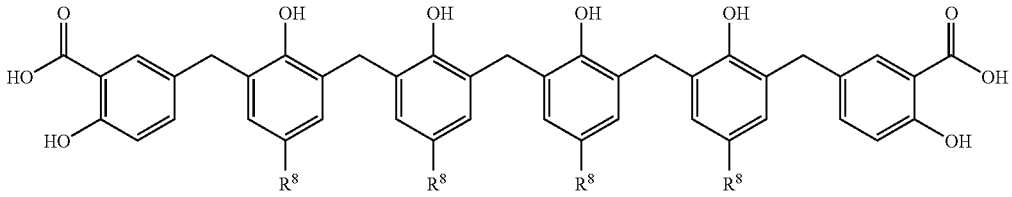

wherein each $R^8$ can be the same or different, and are hydrogen, an alkyl group or mixtures thereof provided at least one $R^8$ is alkyl. In a preferred embodiment, is a polyisobutene group (especially of molecular weight 200 to 1,000, or about 550). Significant amounts of di-or trinuclear species may also be present containing one salicylic end group of formula (III). The salixarate detergent may be used alone or with other detergents.

In one embodiment the overbased metal salt of hydrocarbyl-substituted organic acid is the metal salt of the hydrocarbyl-substituted hydroxy-aromatic acid (preferably hydroxy-benzoic acid) such as a metal salixarate, and the metal ratios are often 5:1 to 35:1. Often the metal ratio is at least 8, preferably at least 12, more preferably at least 15 and most preferably at least 17.

Often the overbased metal salt of hydrocarbyl-substituted hydroxy-aromatic acid (preferably hydroxy-benzoic acid) is a detergent especially a metal salixarate with a TBN (Total Base Number) of at least 80, more preferably at least 90, and more preferably at least 110, even more preferably at least 120. In one embodiment the overbased salixarate detergent has a TBN of about 124. In one embodiment the overbased salixarate detergent has a TBN of about 280.

In one embodiment of the invention the metal salt selected from the group consisting of a hydrocarbyl-substituted organic acid, a hydrocarbyl-substituted phenol and mixtures thereof, includes a metal salt of a hydrocarbyl-salicylate including those represented by the formula:

(VI)

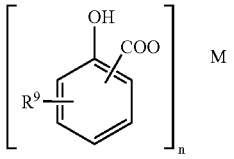

wherein M is a valence of a metal ion, n is an integer equal to or less than the available valence of M. $R^9$ is a hydrocarbyl group. Preferably the hydrocarbyl group has 6 to 50, preferably 8 to 30 and most preferably 8 to 25 carbon atoms; and the hydrocarbyl group includes cyclic acyclic moieties or mixtures thereof. The hydrocarbyl group is preferably selected from the group consisting of an alkyl, cycloalkyl, aryl, acyl and mixtures thereof. Most preferably the hydrocarbyl group is an alkyl group.

The COO group is positioned at an ortho, meta or para position relative to the hydroxyl group; preferably the ortho, para position or mixtures thereof; and most preferably at the otho position. When the COO group is ortho to the hydroxyl group the hydrocarbyl-substituted salicylic acid is a hydrocarbyl-substituted 1,2-salicylic acid. When the COO group is meta to the hydroxyl group the hydrocarbyl-substituted salicylic acid is a hydrocarbyl-substituted 3-hydroxyaromatic acid. When the COO group is para to the hydroxyl group the hydrocarbyl-substituted salicylic acid is a hydrocarbyl-substituted 3-hydroxyaromatic acid.

Examples of a hydrocarbyl group independently suitable for $R^9$ include octyl, n-octyl, 2-ethylhexyl, nonyl, decyl, undecyl, dodecyl, tridecyl, tetradecyl, pentadecyl, hexadecyl, heptadecyl, octadecyl, octadecenyl, nonodecyl, eicosyl, iso-nonyl, iso-decyl, iso-undecyl, iso-dodecyl, iso-tridecyl, iso-tetradecyl, iso-pentadecyl, iso-hexadecyl, iso-heptadecyl, iso-octadecyl, iso-octadecenyl, iso-nonodecyl, iso-eicosyl or mixtures thereof.

M is a valence the metal ion and may be monovalent, divalent, trivalent or mixtures of such metals. When monovalent, the metal M can be an alkali metal, preferably lithium, sodium, or potassium; and more preferably potassium, which can be used alone or in combination with other metals. When divalent, the metal M can be an alkaline earth metal, preferably magnesium, calcium, barium or mixtures of such metals, more preferably calcium, which can be used alone or in combination with other metals. When trivalent, the metal M may be aluminium, which can be used alone or in combination with other metals. In one embodiment the metal is an alkaline earth metal. In one embodiment the metal is calcium, which can be used alone or in combination with other metals.

In one embodiment the overbased metal salt of hydrocarbyl-substituted organic acid is the metal salt of hydrocarbyl-salicylate and the metal ratios are often 5:1 to 35:1. Often the metal ratio is at least 8, preferably at least about 12, more preferably at least about 15 and most preferably at least about 17. Often the overbased metal salt of metal salt of hydrocarbyl-salicylate is a detergent especially with a TBN of at least 80, more preferably at least 90, and more preferably at least 110, even more preferably at least 120.

Metal Salt of a Hydrocarbyl-Substituted Sulphonic Acid

In one embodiment of the invention the metal salt selected from the group consisting of a hydrocarbyl-substituted organic acid, a hydrocarbyl-substituted phenol and mixtures thereof, includes a metal salt of the hydrocarbyl-substituted sulphonic acid including those represented by the formula:

$$(R^{10})_k—A—SO_3M \quad (VII)$$

wherein, each $R^{10}$ is independently a hydrocarbyl group. Preferably the hydrocarbyl group has 6 to 40, preferably 8 to 35 and most preferably 9 to 30 carbon atoms; A can be cyclic or acyclic moieties or mixtures thereof. The hydrocarbyl group is preferably selected from the group consisting of an alkyl, cycloalkyl, aryl, acyl and mixtures thereof. Most preferably the hydrocarbyl group is an alkyl group.

In one embodiment k is 1 and $R^{10}$ is a branched alkyl group with 6 to 40 carbon atoms. In one embodiment k is 1 and $R^{10}$ is a linear or branched alkyl group with 6 to 40 carbon atoms. M is a valence of a metal ion, as defined above.

The metal salt of the hydrocarbyl-substituted sulphonic acid has a hydrocarbyl-substituted sulphonic group that includes natural, synthetic or mixtures thereof. Suitable examples of the hydrocarbyl-substituted sulphonic acid include polypropene benzenesulphonic acid; and monoalkyl and dialkyl benzenesulphonic acids wherein the alkyl groups contain at least 10 carbons for example, 14, 15, 16, 17, 18, 19, 20, 21, 22, 23, 24, 25, 26, 27, 28, 29, 30 and mixtures thereof.

Examples of a suitable alkyl group include branched and/or linear decyl, undecyl, dodecyl, tridecyl, tetradecyl, pentadecyl, hexadecyl, heptadecyl, octadecyl, octadecenyl, nonodecyl, eicosyl, un-eicosyl, do-eicosyl, tri-eicosyl, tetra-eicosyl, penta-eicosyl, hexa-eicosyl or mixtures thereof Preferred examples of hydrocarbyl-substituted sulphonic acid include polypropene benzenesulphonic acid and $C_{16}$-$C_{24}$ alkyl benzenesulphonic acid or mixtures thereof.

When A is cyclic suitable groups include phenyl or fused bicyclic such as naphthalene, indenyl, indanyl, bicyclopentadienyl and mixtures thereof. Although A includes a fused bicyclic ring, phenyl rings are preferred.

When A is a chain, the chain can be linear, branched and mixtures thereof, although linear is preferred. Suitable groups include derivatives of carboxylic acids containing 7 to 30, preferably 7 to 20, more preferably 8 to 20 and most preferably 8 to 15 carbon atoms. Further the chain can be saturated or unsaturated, although saturated is preferred.

In one embodiment the overbased metal salt of hydrocarbyl-substituted organic acid is the metal salt of the hydrocarbyl-substituted sulphonic acid and the metal ratios are often 10:1 to 35:1. Often the metal ratio is at least 20, preferably at least about 22, more preferably at least about 25 and most preferably at least about 27.

The overbased detergent often has a low in-process viscosity and a low final viscosity. As used herein the term "low" used in "low in-process viscosity" and a "low final viscosity" defines a viscosity that is lower than would be expected from a conventional overbased metal detergent.

The final product often has a handle-able final viscosity of less than 300 $mm^2s^{-1}$, preferably less than 200 $mm^2s^{-1}$, more preferably less than 190 $mm^2s^{-1}$ an most preferably less than 180 $mm^2s^{-1}$ at 100° C.

Often the overbased metal salt of hydrocarbyl-substituted sulphonic acid is a detergent especially an overbased metal sulphonate with a TBN (Total Base Number) of at least 400, more preferably at least 425, and more preferably at least 450, even more preferably at least 490. In one embodiment the overbased sulphonate detergent has a TBN of about 500.

In one embodiment of the invention provides in step (1) a metal salt of a phenate such as a sulphur containing phenate, a alkylene (preferably methylene) coupled phenate or mixtures thereof. The preparation of the phenate materials listed above are known in the art.

In one embodiment of the invention provides in step (1) a metal salt of a hydrocarbyl-substituted carboxylate or mixtures thereof. Examples of a suitable carboxylic acid used to prepare the hydrocarbyl-substituted carboxylate include 2-methyl-2-heptenoic acid, 5-methyl-2-hexenoic acid, 3-methyl-2-heptenoic acid, 2,4,4-trimethyl-2-pentenoic acid, 4,4-dimethyl-2-pentenoic acid, 3-ethyl-2-hexenoic acid, 2-heptenoic acid, 2,3-dimethyl-2-pentenoic acid, 3,5-dimethyl-2-hexenoic acid, 2-methyl-2-pentenoic acid, 3,4,4-trimethyl-2-pentenoic acid, 3-propyl-2-hexenoic acid, 4-methyl-2-pentenoic acid, 2,4-dimethyl-2-pentenoic acid, 3-ethyl-2-pentenoic acid, 3,4-dimethyl-2-pentenoic acid, 4-methyl-2-hexenoic acid, 2,4-dimethyl-2-hexenoic acid, 3-butyl-2-heptenoic acid, 2,5-dimethyl-2-hexenoic acid, 2-methyl-2-hexenoic acid, 3-ethyl-2-methyl-2-pentenoic acid, decanoic acid, isodecanoic acid, dodecanoic acid, tridecanoic acid, butadecanoic acid, myristic acid, pentadecanoic acid, palmitic acid, hexadecanoic acid, heptadecanoic acid, stearic acid, octacdecanoic acid, icosyldecanoic acid, icosanoic acid or mixtures thereof.

Mixture of Alcohols

The alcohols include methanol and a mixture of alcohols containing 2 to 7, preferably 2 to 6, more preferably 2 to 5 and most preferably 3 to 5 carbon atoms. The mixture of alcohols containing 2 to 7 carbon atoms can include branched or linear alkyl chains or mixtures thereof, although branched is preferred.

The mixture of alcohols can contain ethanol, propan-1-ol, propan-2-ol, isopropanol, butan-1-ol, butan-2-ol, isobutanol, pentan-1-ol, pentan-2-ol, pentan-3-ol, isopentanol, hexan-1-ol, hexan-2-ol, hexan-3-ol, heptan-1-ol, heptan-2-ol, heptan-3-ol, heptan-4-ol or mixtures thereof. Preferably the mixture of alcohols contains at least one butanol and at least one amyl alcohol. The mixture of alcohols is commercially available as isoamyl alcohol from Union Carbide or other suppliers.

The mole ratio of methanol to the mixture of alcohols is often below 2.2, preferably 1.70, more preferably 0.9 to 1.60, even more preferably 1 to 1.50, even more preferably 1 to 1.45 and most preferably 1.1 to 1.40.

In one embodiment the hydrocarbyl-substituted organic acid is the metal salt of the hydrocarbyl-substituted sulphonic acid and the mole ratio of methanol to the mixture of alcohols is often below 1.7, preferably 0.9 to 1.60, more preferably 1 to 1.50, even more preferably 1 to 1.45 and most preferably 1.1 to 1.40.

In one embodiment the hydrocarbyl-substituted organic acid is the metal salt of hydrocarbyl-substituted hydroxy-aromatic acid such as a metal salixarate and the mole ratio of methanol to the mixture of alcohols is often less than 2.2, preferably less than 2.1, more preferably 0.9 to 2.05, more preferably 1 to 2, even more preferably 1.2 to 2 and most preferably 1.2 to 1.95.

The amount of methanol and a mixture of alcohols containing 2 to 7 carbon atoms present in the solvent system is more than 90 wt %, preferably more than 95 wt %, more preferably more than 98 wt % and most preferably more than 99.5 wt %. In one embodiment the solvent system contains only methanol and a mixture of alcohols containing 2 to 7 carbon atoms.

Oil Medium

The invention further includes an oil medium (considered to be distinct and not part of the hydrocarbon solvent described above), especially an oil of lubricating viscosity. The oil includes natural and synthetic oils, oil derived from hydrocracking, hydrogenation, hydrofinishing, unrefined, refined and re-refined oils, or mixtures thereof.

Unrefined oils are those obtained directly from a natural or synthetic source generally without (or with little) further purification treatment.

Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include animal oils, vegetable oils (e.g., castor oil, lard oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerised and interpolymerised olefins (e.g., polybutylenes, polypropylenes, propyleneisobutylene copolymers); poly(1-hexenes), poly(1-octenes), poly(1-decenes), and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); alkylated diphenyl ethers and alkylated diphenyl sulphides and the derivatives, analogs and homologs thereof or mixtures thereof.

Other synthetic lubricating oils include liquid esters of phosphorus-containing acids (e.g., tricresyl phosphate, trioctyl phosphate, and the diethyl ester of decane phosphonic acid), and polymeric tetrahydrofurans. Synthetic oils may be produced by Fischer-Tropsch reactions and often may be hydroisomerised Fischer-Tropsch hydrocarbons or waxes.

Oils of lubricating viscosity can also be defined as specified in the American Petroleum Institute (API) Base Oil Interchangeability Guidelines. The five base oil groups are as follows: Group I (sulphur content >0.03 wt %, and/or <90 wt % saturates, viscosity index 80-120); Group II (sulphur content ≦0.03 wt %, and ≧90 wt % saturates, viscosity index 80-120); Group III (sulphur content ≦0.03 wt %, and ≧90 wt % saturates, viscosity index ≧120); Group IV (all polyalphaolefins (PAOs)); and Group V (all others not included in Groups I, II, III, or IV). The oil of lubricating viscosity comprises an API Group I, II, III, IV, V oil and mixtures thereof. Preferably the oil of lubricating viscosity is an API Group I, II, III oil or mixtures thereof.

Optional Performance Additives

The detergent can be incorporated into a lubricating oil composition that optionally includes at least one other performance additive selected from the group consisting of metal deactivators, detergents other than those prepared by the process of the invention, dispersants, antioxidants, anti-wear agents, corrosion inhibitors, antiscuffing agents, extreme pressure agents, foam inhibitors, demulsifiers, friction modifiers, viscosity modifiers, pour point depressants and mixtures thereof. Often fully-formulated lubricating oil will contain one or more of these additives.

Industrial Application

The metal salt selected from the group consisting of a hydrocarbyl-substituted organic acid; a hydrocarbyl-substituted phenol and mixtures thereof of the present invention are useful as detergents in lubricants for internal combustion engines, for example diesel fuelled engines, gasoline fuelled engines, natural gas fuelled engines or mixed gasoline/alcohol fuelled engines.

In one embodiment of the invention provides a method for lubricating an internal combustion engine, comprising supplying thereto a lubricant comprising the composition as described herein. The invention is suitable for 2-stroke or 4-stroke engines, in particular marine diesel engines, especially 2-stroke marine diesel engines.

The following examples provide an illustration of the invention. These examples are non exhaustive and are not intended to limit the scope of the invention.

EXAMPLES

Preparative Example 1

Preparation of Salixarate Substrate—Salixarene

A sample of a salixarene substrate is prepared using a flange flask approximately 2 litres in volume, a flange and clip, overhead stirrer with paddle and polytetrafluoroethylene (PTFE) stirrer gland, Dean Stark trap and double surface condenser, an electric mantle/thermocouple/Eurotherm™ temperature controller system, the glassware from just above the mantle to just below the condenser being covered with glass wool. The flask is filled with 475 g polyisobutenyl phenol with a number average molecular weight of 550 (derived from GLISSOPAL® 550 commercially available from BASF) and 330 g of mineral oil (SN 150) and heated to 30° C. via a pressure equalizing dropping funnel 3.4 g of 50% aqueous KOH is added. The contents of the flask heated to 75° C. and the temperature is kept constant for 30 minutes while 81.6 g of 37% aqueous formaldehyde (formalin) is added. The reaction is charged with 51.6 g of salicylic acid and heated to 140° C. while controlling reflux. Water is removed using Dean Stark trap. The product is vacuum stripped at 140° C./13 kPa (equivalent to 100 mm Hg) for 30 minutes. The product contains 2 methylene bridged polyisobutenyl phenol molecules methylene bridged to one salicylic acid. A more detailed description of the reaction process is given in Example 1 and 5 of International Publication WO03/018728, pages 22 and 23.

Example 1

Preparation of 124 TBN Calcium Salixarate

A vessel equipped with a stirrer, sparging tube, thermowell and condenser is charged with 63.4 parts by weight of the product of Preparative Example 1 and 14.7 parts by weight of oil. The reactor is charged with 12.1 parts by weight of a methanol and a mixture of iso-butanol/amyl alcohol. The ratio of methanol to the mixture of iso-butanol/amyl alcohol is 1.88. The reactor is charged with 9.7 parts by weight of calcium hydroxide, 1.2 parts by weight water and 0.05 parts by weight acetic acid and the mixture is heated to 54° C. at which point carbon dioxide is added to form a carbonated product. The carbonated product is further treated three more times with similar (or equal) portions of calcium hydroxide and carbon dioxide. Water is removed by stripping before repeating the addition of alcohol, calcium hydroxide and carbon dioxide 2 times. The product is stripped and filtered.

Example 2 is the same as example 1 except it is carried out on a larger scale.

Example 3

Preparation of 280 TBN Calcium Salixarate

Example 3 is prepared in the same process as Example 1, except the reactor is charged with 47.7 parts by weight of the product of Preparative Example 1 and 26.5 parts by weight of oil 21.8 parts by weight of a methanol and a mixture of iso-butanol/amyl alcohol. The ratio of methanol to the mixture of iso-butanol/amyl alcohol is 1.63. The reactor is charged with 4 parts by weight of calcium hydroxide, 0.1 parts by weight water and 0.03 parts by weight acetic acid and the mixture is heated to 54° C. where carbon dioxide is added to form a carbonated product. The carbonated product is further treated three more times with similar (or equal) portions of calcium hydroxide and carbon dioxide. Water is removed by stripping before repeating the addition of alcohol, calcium hydroxide and carbon dioxide 2 times. The product is stripped and filtered.

Example 4

Preparation of Calcium Salixarate

Example 4 is prepared in a similar manner to Example 1 except the methanol to the mixture of iso-butanol/amyl alcohol is 1.91.

Example 5

Preparation of Calcium Salixarate

Example 5 is prepared in a similar manner to Example 3 except 6.8 parts by weight of calcium hydroxide is used.

Example 6

Preparation of Calcium Salixarate

The process is the same as Example 1 except the number of times the steps repeating the addition of alcohol, calcium hydroxide and carbon dioxide after the stripping of water is 3 instead 2.

Example 7

Preparation of Calcium Hexadecyl Salicylate

The process is the same as Example 1 except hexadecyl salicylic acid is used instead of the product from Preparative Example 1.

Example 8

Preparation of Calcium Hexadecyl Salicylate

The process is the same as Example 7 except the ratio of methanol to the mixture of iso-butanol/amyl alcohol is 1.73.

Example 9

Preparation of Calcium Hexadecyl Salicylate

The process is the same as Example 7 except the number of times the steps repeating the addition of alcohol, calcium hydroxide and carbon dioxide after the stripping of water is 3 instead 2.

Example 10

Preparation of 500 TBN Calcium Sulphonate

A sample of a 500 TBN sulphonate detergent is prepared using a flange vessel, a flange and clip, overhead stirrer with paddle and polytetrafluoroethylene (PTFE) stirrer gland, Dean Stark trap and double surface condenser, a mantle/thermocouple temperature controller system, the equipment from just above the mantle to just below the condenser being covered with glass wool. The vessel is charged with 35.1 parts by weight of $C_{16}$-$C_{24}$ alkylbenzene sulphonic acid and 31.8 parts by weight of mineral oil (SN 150) and heated to 30° C. The reactor is charged through a port with alcohols containing methanol and a mixture of iso-butanol/amyl alcohol present at 11.6 parts by weight. The weight ratio of methanol to the mixture of iso-butanol/amyl alcohol is 1.31. The reactor is charged with 14.9 parts by weight of calcium hydroxide and the mixture is heated to 54° C. at which point carbon dioxide is added to form a carbonated product. The carbonated product is further treated three more times with similar (or equal) portions of calcium hydroxide and carbon dioxide. Water is removed by stripping before repeating the addition of alcohol, calcium hydroxide and carbon dioxide 2 times. The product is stripped and filtered.

Example 11

Preparation of Calcium Sulphonate

The process is the same as Example 10 except the number of times the steps repeating the addition of alcohol, calcium hydroxide and carbon dioxide after the stripping of water is 3 instead 2.

Example 12

Preparation of Calcium Sulphonate

The process is the same as Example 10 except a mixture of polypropylene alkylbenzene sulphonic acid is used instead of the mixture of $C_{16}$-$C_{24}$ alkylbenzene sulphonic acid.

Example 13

Preparation of Calcium Sulphonate

The process is the same as Example 10 except the methanol to mixture of iso-butanol/amyl alcohol ratio is 1.19.

In this specification the terms "hydrocarbyl substituent" or "hydrocarbyl group," as used herein are used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration While the invention has been explained, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A process for preparing an overbased metal detergent in an oil medium comprising the steps of:

(1) providing an oil medium and a metal salt selected from the group consisting of a hydrocarbyl-substituted organic acid; a hydrocarbyl-substituted phenol, a phenate, a hydrocarbyl-substituted carboxylate and mixtures thereof;

(2) further providing methanol and a mixture of alcohols containing 2 to about 7 carbon atoms, wherein the mole ratio of methanol to the mixture of alcohols is about 2.2 or less;

(3) further providing a basic metal compound, to form a mixture;

(4) reacting the mixture of step (3) with carbon dioxide to form a carbonated overbased metal detergent;

(5) performing steps (3) and (4) at least three additional times upon the product of step (4);

(6) thereafter removing at least a portion of the water produced in steps (1)-(5) and of the alcohols introduced in step (2);

(7) performing step (2) again, upon the product of step (6);

(8) performing steps (3) and (4) at least two additional times upon the product of step (7); and (9) thereafter removing a substantial portion of the water and of the alcohols from the composition;

wherein the oil medium is present in an amount such that the weight ratio of the acid corresponding to the metal salt of (1) to the oil medium is 0.3 to 1.4.

2. The process of claim 1, wherein the process further comprises a processing step of filtering or stripping the product of step (9) to form the overbased metal detergent.

3. The process of claim 1, wherein the process is free of co-surfactant or co-promoter other than the mixture of alcohols.

4. The process of claim 1, wherein any residual solids and any residual water and alcohols are substantially completely removed from the product.

5. The process of claim 1 wherein about 10 to about 20 percent by weight of the total amount of the basic metal compound is added at each occurrence of step (3).

6. The process of claim 1 wherein the basic metal compound is calcium oxide or calcium hydroxide or mixtures thereof.

7. The process of claim 1, wherein the mixture of alcohols contains at least one butanol and at least one amyl alcohol.

8. The process of claim 1, wherein the removal of at least a portion of the water in step (9) is carried out by flash stripping.

9. The process of claim 8, wherein the flash stripping is carried out at a temperature of at least about 125° C.

10. The process of claim 1, wherein the oil medium is substantially free of hydrocarbon solvent other than oil of lubricating viscosity.

11. The process of claim 1, wherein the metal salt of step (1) is a metal salt of a hydrocarbyl-substituted sulphonic acid is represented by the formula:

$$(R^1)_k—A—SO_3M$$

wherein each $R^1$ is independently a hydrocarbyl group having about 6 to about 40 carbon atoms; A is a cyclic or acyclic hydrocarbon group; M is a valence of at least one metal ion; and k is 1 to about 5.

12. The process of claim 11 wherein M is a valence of calcium.

13. The process of claim 11, wherein the total base number of the metal salt of the hydrocarbyl-substituted sulphonic acid is at least about 400.

14. The process of claim 11, wherein the metal ratio of the metal salt of the hydrocarbyl-substituted sulphonic acid is at least about 20.

15. The process of claim 11, wherein the metal salt of the hydrocarbyl-substituted sulphonic acid is prepared using a mole ratio of methanol to the mixture of alcohols of about 1 to about 1.45.

16. The process of claim 1, wherein the metal salt of step (1) is a metal salixarate.

17. The process of claim 16, wherein M is a valence of calcium.

18. The process of claim 16, wherein the total base number of the metal salt of the salixarate is at least about 90.

19. The process of claim 16, wherein the metal salt of the salixarate is prepared using a mole ratio of methanol to the mixture of alcohols of less than about 2.2.

20. The process of claim 1, wherein the co-surfactant or co-promoter are selected from the group consisting of a calcium salt of formaldehyde coupled aliphatic phenols, a hydroxy-sulphonic acids, inorganic halides or inorganic calcium salts.

21. A process for preparing an overbased metal detergent in an oil medium comprising the steps of:

(1) providing an oil medium and a metal salt selected from the group consisting of a hydrocarbyl-substituted organic acid; a hydrocarbyl-substituted phenol, a phenate, a hydrocarbyl-substituted carboxylate and mixtures thereof;

(2) further providing methanol and a mixture of alcohols containing 2 to about 7 carbon atoms, wherein the mole ratio of methanol to the mixture of alcohols is about 2.2 or less;

(3) further providing a basic metal compound, to form a mixture.

(4) reacting the mixture of step (3) with carbon dioxide to form a carbonated overbased metal detergent;

(5) performing steps (3) and (4) at least three additional times upon the product of step (4);

(6) thereafter removing at least a portion of the water produced in steps (1)-(5) and of the alcohols introduced in step (2);

(7) performing step (2) again, upon the product of step (6);

(8) performing steps (3) and (4) at least two additional times upon the product of step (7);

(9) thereafter removing a substantial portion of the water and of the alcohols from the composition; and

(10) a processing step of filtering or stripping the product of step (9) to form the overbased metal detergent, wherein the process is free of co-surfactant or co-promoter other than the mixture of alcohols; wherein the oil medium is present in an amount such that the weight ratio of the acid corresponding to the metal salt of (1) to the oil medium is 0.3 to 1.4.

* * * * *